US010349472B2

(12) United States Patent
Deng

(10) Patent No.: US 10,349,472 B2
(45) Date of Patent: Jul. 9, 2019

(54) CEILING LAMP

(71) Applicant: DONGGUAN PAN AMERICAN ELECTRONICS CO., LTD., DongGuan (CN)

(72) Inventor: Jinsheng Deng, DongGuan (CN)

(73) Assignee: DONGGUAN PAN AMERICAN ELECTRONICS CO., LTD., DongGuan (CN)

( * ) Notice: Subject to any disclaimer, the term of this patent is extended or adjusted under 35 U.S.C. 154(b) by 20 days.

(21) Appl. No.: 15/643,489

(22) Filed: Jul. 7, 2017

(65) Prior Publication Data

US 2018/0279428 A1 Sep. 27, 2018

(30) Foreign Application Priority Data

Mar. 24, 2017 (CN) ..... 2017 2 0305884 U

(51) Int. Cl.

| | |
|---|---|
| ***F21S 8/04*** | (2006.01) |
| ***H05B 33/08*** | (2006.01) |
| ***F21V 3/00*** | (2015.01) |
| ***F21V 15/01*** | (2006.01) |
| *F21V 23/00* | (2015.01) |
| *F21Y 115/10* | (2016.01) |
| *F21V 3/06* | (2018.01) |

(52) U.S. Cl.

CPC ..... *H05B 33/0809* (2013.01); *F21S 8/04* (2013.01); *F21V 3/00* (2013.01); *F21V 15/01* (2013.01); *F21V 3/0615* (2018.02); *F21V 23/005* (2013.01); *F21Y 2115/10* (2016.08)

(58) Field of Classification Search

CPC .. F21S 8/04; F21V 17/06; F21V 17/10; F21V 17/12; F21V 15/01; F21V 3/00; F21V 3/0615; F21Y 2115/10

See application file for complete search history.

(56) References Cited

U.S. PATENT DOCUMENTS

| | | | | |
|---|---|---|---|---|
| 6,045,240 | A * | 4/2000 | Hochstein | B60Q 1/2696 362/294 |
| 6,435,691 | B1 * | 8/2002 | Macey | F21S 8/024 362/101 |
| 6,964,501 | B2 * | 11/2005 | Ryan | F21V 29/004 362/294 |
| 7,771,085 | B2 * | 8/2010 | Kim | F21V 21/002 313/292 |

(Continued)

*Primary Examiner* — Tung X Le
*Assistant Examiner* — Borna Alaeddini
(74) *Attorney, Agent, or Firm* — Platinum Intellectual Property LLP

(57) ABSTRACT

A ceiling lamp includes a lamp housing comprising a mounting bracket, a mounting pedestal mounted on the mounting bracket, an insulating cover connected to the mounting pedestal, and a lampshade enclosing the mounting bracket. The ceiling lamp further includes a light source assembly mounted in the lamp housing, the light source assembly includes a PCB, a plurality of LED beads mounted on a bottom surface of the PCB, and a processing circuit integrated on the PCB. The processing circuit includes a power consumption module electrically coupled to a mains power supply, a rectifier module electrically coupled to the power consumption module, and a constant current module electrically coupled to the rectifier module. The power consumption module comprising a fusing resistor and a varistor.

8 Claims, 6 Drawing Sheets

(56) References Cited

U.S. PATENT DOCUMENTS

| | | | | |
|---|---|---|---|---|
| 2008/0285271 | A1* | 11/2008 | Roberge | F21S 8/033<br>362/235 |
| 2011/0043120 | A1* | 2/2011 | Panagotacos | B64D 47/04<br>315/224 |
| 2015/0338077 | A1* | 11/2015 | Johnson | F21V 23/005<br>362/234 |

* cited by examiner

CEILING LAMP

CROSS REFERENCE TO RELATED APPLICATION

This application claims priority under 35 U.S.C. § 119 to Chinese Patent Application No. 201720305884.0, filed on Mar. 24, 2017, the entire content of which is incorporated herein in its entirety.

FIELD OF THE INVENTION

The present disclosure relates to the field of lamp lighting technology, and more particularly relates to a ceiling lamp.

BACKGROUND OF THE INVENTION

As a new type of light source, light emitting diode (LED) lamps have shown their wide range of applications due to the features such as energy saving, high efficiency and low cost, etc. In more and more applications, users prefer to use LED lamps to replace the traditional fluorescent lamps.

Since the LED lamps is driven by the direct current, and need a stable current to ensure its serving life. While the current LED lamps are generally connected to a mains power supply, when the power is turned on and off, it is prone to occur the voltage and current fluctuations. Such fluctuations may affect the luminous stability and the service life. Thus, it is necessary to design stable LED lamps.

SUMMARY

Therefore, it is necessary to provide a ceiling lamp, which has the high luminous stability and long service life.

A ceiling lamp includes a lamp housing comprising a mounting bracket, a mounting pedestal mounted on the mounting bracket, an insulating cover connected to the mounting pedestal, and a lampshade enclosing the mounting bracket. The ceiling lamp further includes a light source assembly mounted in the lamp housing, the light source assembly includes a printed circuit board (PCB), a plurality of LED beads mounted on a bottom surface of the PCB, and a processing circuit integrated on the PCB. The processing circuit is electrically coupled to the plurality of LED beads, the processing circuit includes a power consumption module electrically coupled to a mains power supply, a rectifier module electrically coupled to the power consumption module, and a constant current module electrically coupled to the rectifier module. The power consumption module includes a fusing resistor and a varistor, the fusing resistor is electrically coupled to a live wire of the mains power supply, and both terminals of the varistor are electrically coupled to the live wire and a neutral wire of the mains power supply, respectively. The constant current module is configured to supply power to the plurality of LED beads.

These and other objects, advantages, purposes and features will become apparent upon review of the following specification in conjunction with the drawings.

BRIEF DESCRIPTION OF THE DRAWINGS

To illustrate the technical solutions according to the embodiments of the present disclosure or in the prior art more clearly, the accompanying drawings for describing the embodiments or the prior art are introduced briefly in the following. The accompanying drawings in the following description are only some embodiments of the present invention, and persons of ordinary skill in the art can derive other obvious variations from the accompanying drawings without creative efforts.

DETAILED DESCRIPTION OF THE EMBODIMENTS

Figure 1:
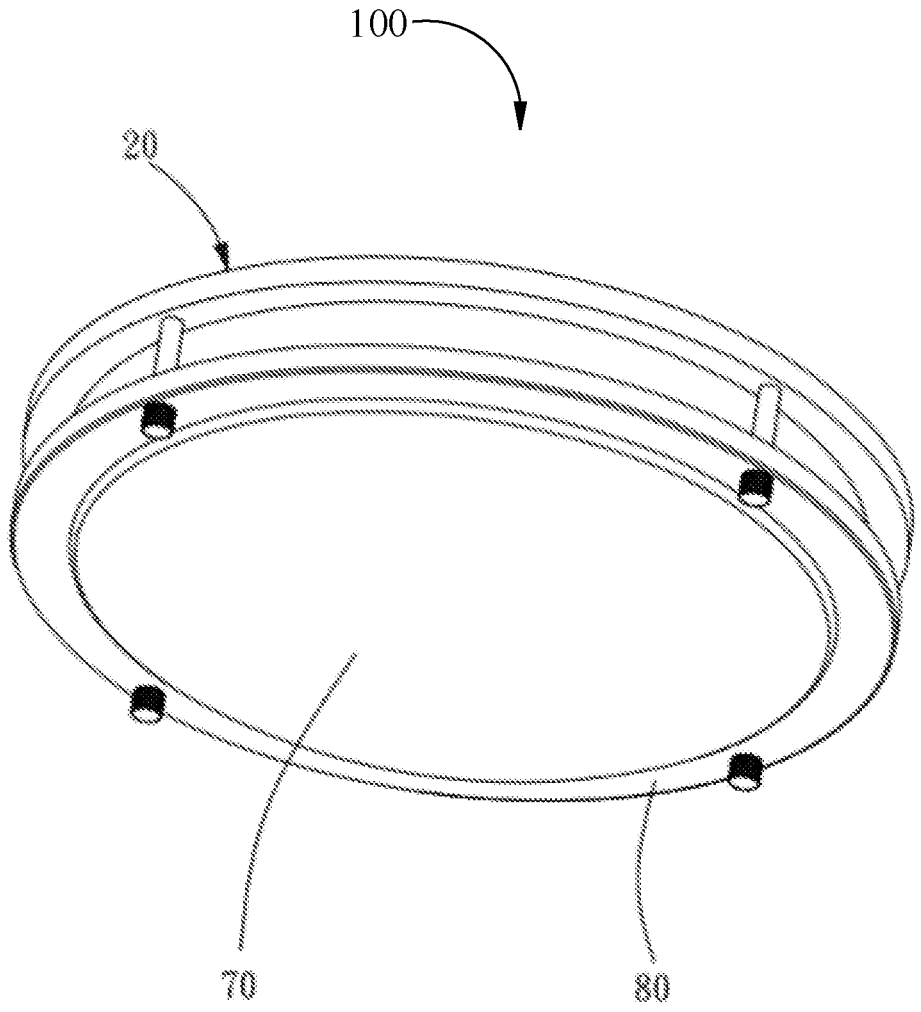
FIG. 1 is a perspective view of a ceiling lamp according to an embodiment.

Embodiments of the invention are described more fully hereinafter with reference to the accompanying drawings. The various embodiments of the invention may, however, be embodied in many different forms and should not be construed as limited to the embodiments set forth herein. Rather, these embodiments are provided so that this disclosure will be thorough and complete, and will fully convey the scope of the invention to those skilled in the art. Elements that are identified using the same or similar reference characters refer to the same or similar elements.

It will be understood that when an element is referred to as being "connected" or "coupled" to another element, it can be directly connected or coupled to the other element or intervening elements may be present. In contrast, if an element is referred to as being "directly connected" or "directly coupled" to another element, there are no intervening elements present.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Figure 2:
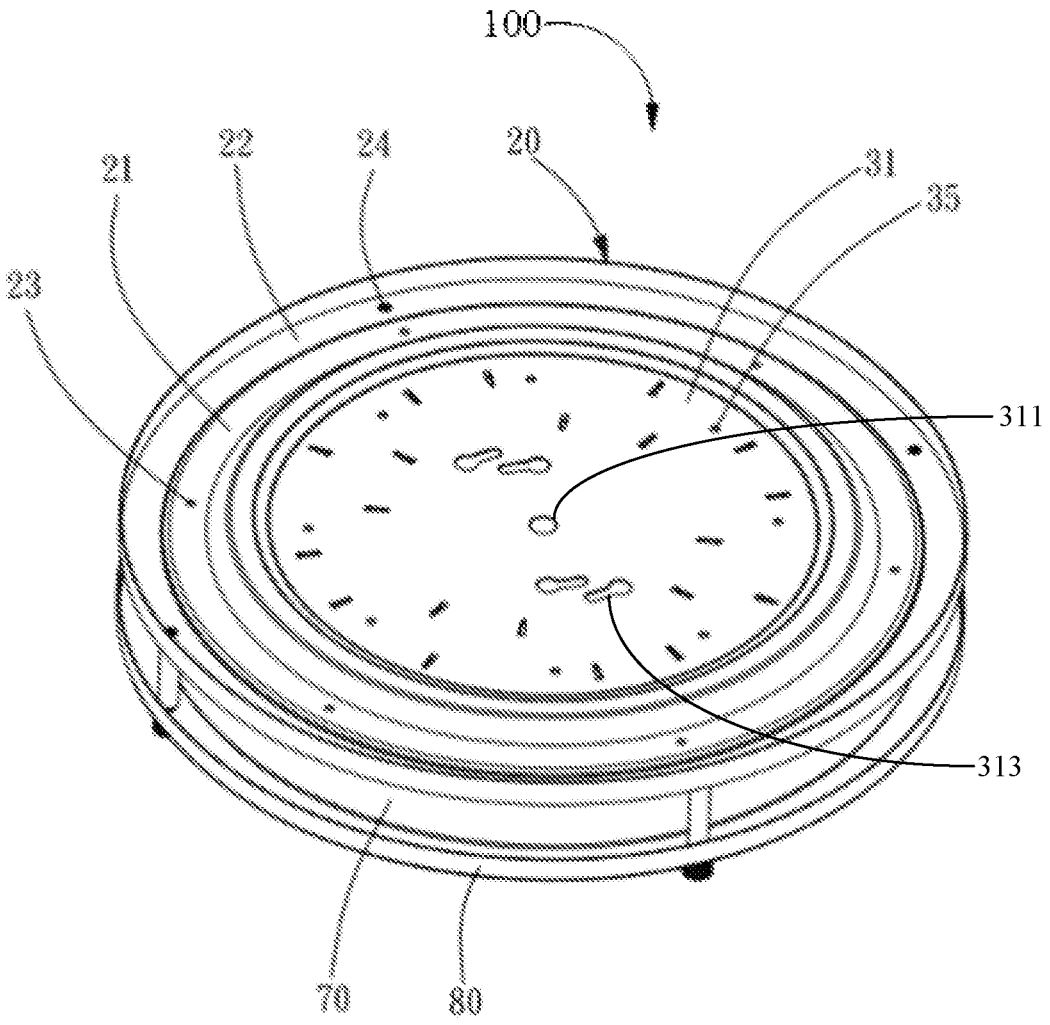
FIG. 2 is similar to FIG. 1, but viewed from another aspect.
Figure 3:
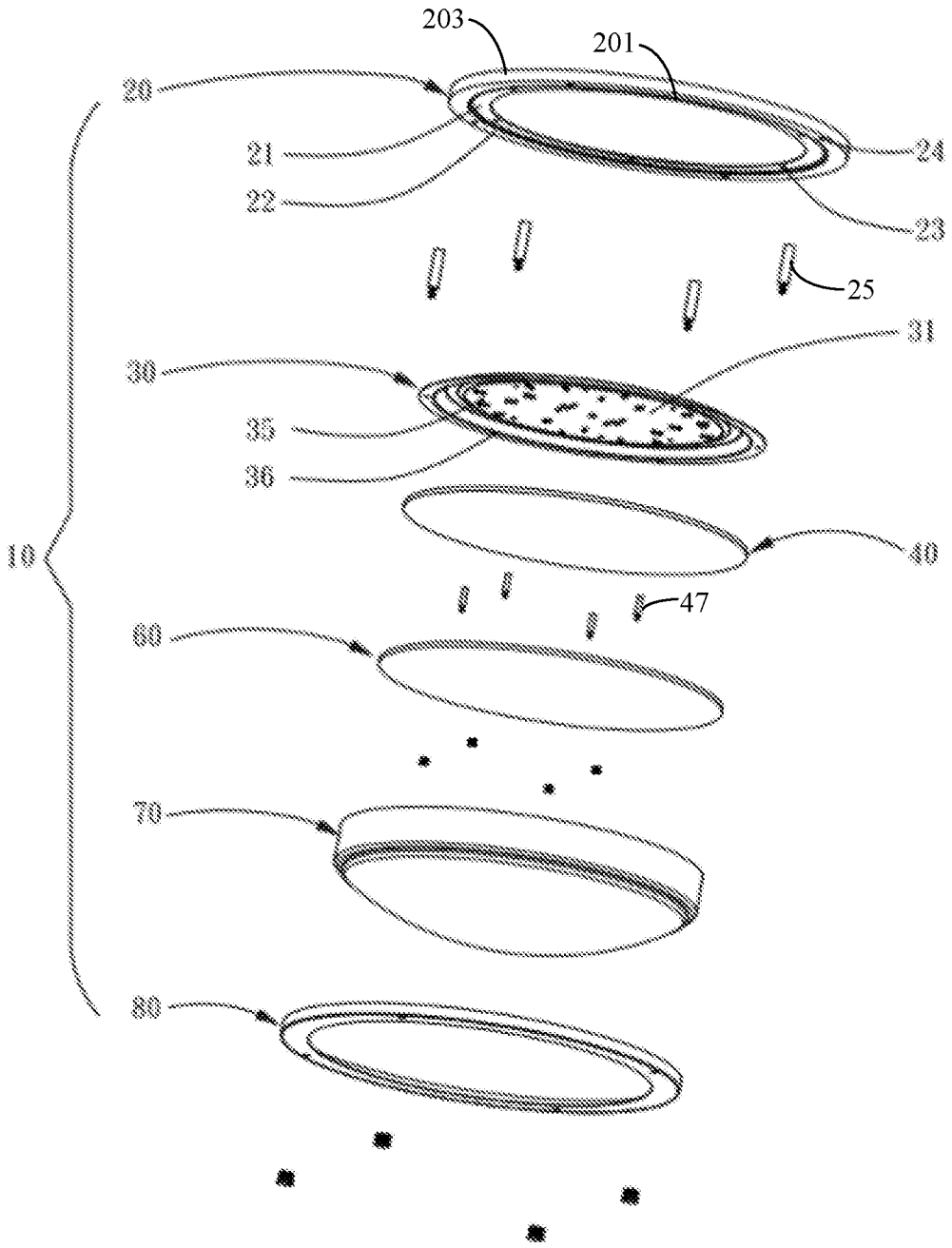
FIG. 3 is an exploded view of the ceiling lamp of FIG. 1.

Referring to FIG. 1 through FIG. 3, a ceiling lamp 100 according to an embodiment includes a lamp housing 10 and a light source assembly 40 mounted in the lamp housing 10.

The lamp housing 10 includes a mounting bracket 20, a mounting pedestal 30 mounted on the mounting bracket 20, an insulating cover 60 connected to the mounting pedestal 30, a lampshade 70 enclosing the mounting bracket 20, and a fixing ring 80 for securing the lampshade 70.

The mounting bracket 20 has an annular shape, which includes an annular base plate 201 and a side plate 203 extending vertically from an outer periphery of the base plate 201. The base plate 201 has an inner ring portion 21 and an outer ring portion 22. The inner ring portion 21 defines a plurality of uniformly spaced first connecting holes 23 arranged on an annular circumference thereof. In the illustrated embodiment, there are six first connecting holes 23. The outer ring portion 22 defines a plurality of uniformly spaced second connecting holes 24 arranged on an annular circumference thereof. In the illustrated embodiment, there are four second connecting holes 24. A plurality of first supporting posts 25 extend through the second connecting holes 24, each first supporting post 25 defines a first threaded hole (not shown) on one end thereof. The first supporting post 25 is fixed to the mounting bracket 20 via a screw extending through the second connecting hole 24. The first supporting post 25 has a first bolt on the other end thereof, the first bolt extends through the fixing ring 80 and is fastened via a first nut.

Figure 4:
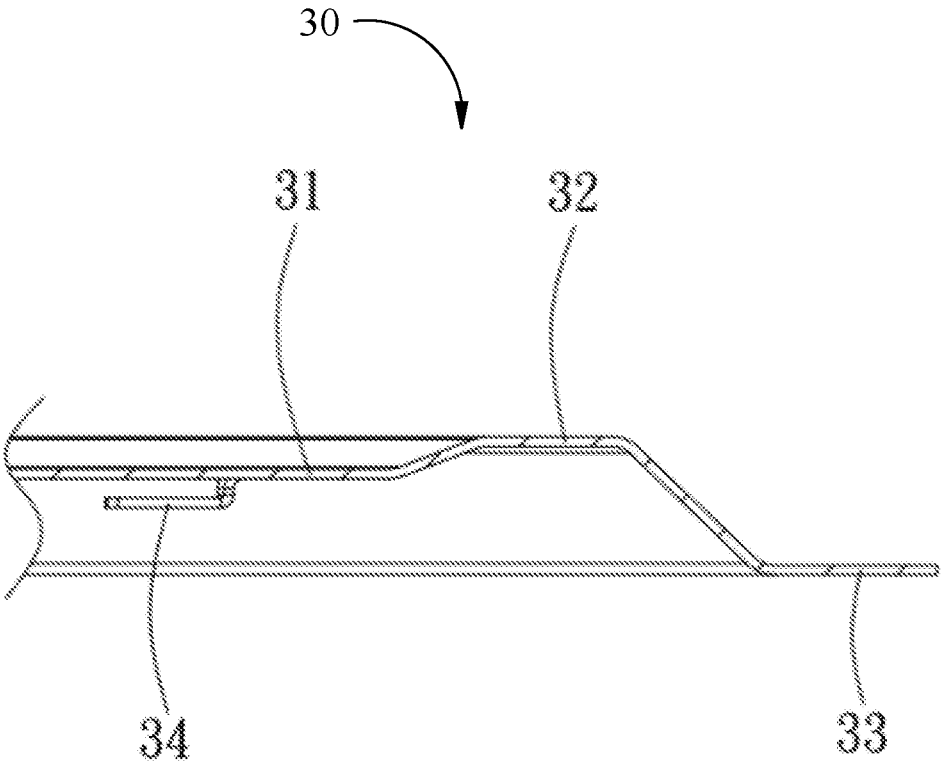
FIG. 4 is a partial cross-sectional view of an mounting pedestal of FIG. 3.

Referring to FIG. 4, the mounting pedestal 30 is a metal piece integrally formed by stamping. The mounting pedestal 30 includes a pedestal portion 31, a bending portion extending from a periphery of the pedestal portion 31, and an abutting portion 33 connected to the bending portion 32. The pedestal portion 31 is a round metal plate. The pedestal portion 31 defines a wiring hole 311 and a plurality of mounting holes 313 located around the wiring hole 311 on a middle portion thereof. The wiring hole 311 is configured to extend through the circuit lines. The mounting hole is configured to fix the ceiling lamp 100 to a ceiling.

The pedestal portion 31 has a plurality of hooks 34 formed on a side towards the insulating cover 60. The plurality of hooks 34 are formed by stamping and randomly distribute on the side of the pedestal portion 31. The pedestal portion 31 also defines a plurality of uniformly spaced third connection holes 35. The mounting pedestal 30 is fixed to the insulating cover 60 via a second screw extending through the third connection holes 35. The bending portion 32 has a substantially an inverted U-shaped cross-section. The bending portion 32 is embedded in an annular inner side of the mounting bracket 20, and the abutting portion 33 is connected to the base plate 201. The abutting portion 33 defines a plurality of fourth connecting hole 36, the fourth connecting hole 36 and the first connecting hole 23 have corresponding locations, and the mounting pedestal 30 connects and fixes to the mounting bracket 20 via screws.

The lampshade 70 has a hollow hemispherical shape, and defines an opening on a side thereof. The light source assembly 40 and the insulating cover 60 is located in the lampshade 70. The lampshade 70 extending from the edge of the opening abuts against the mounting pedestal 30. The lampshade 70 is made of an acrylic material, such that the lampshade 70 can prevent glare while protecting the light source assembly 40, thus protecting eyes to a certain extent. The fixing ring 80 has a roughly annular shape. The fixing ring 80 has an annular inner portion which is configured to hold the lampshade 70 and fixes to the lampshade 70 via the first supporting post 25.

Figure 5:
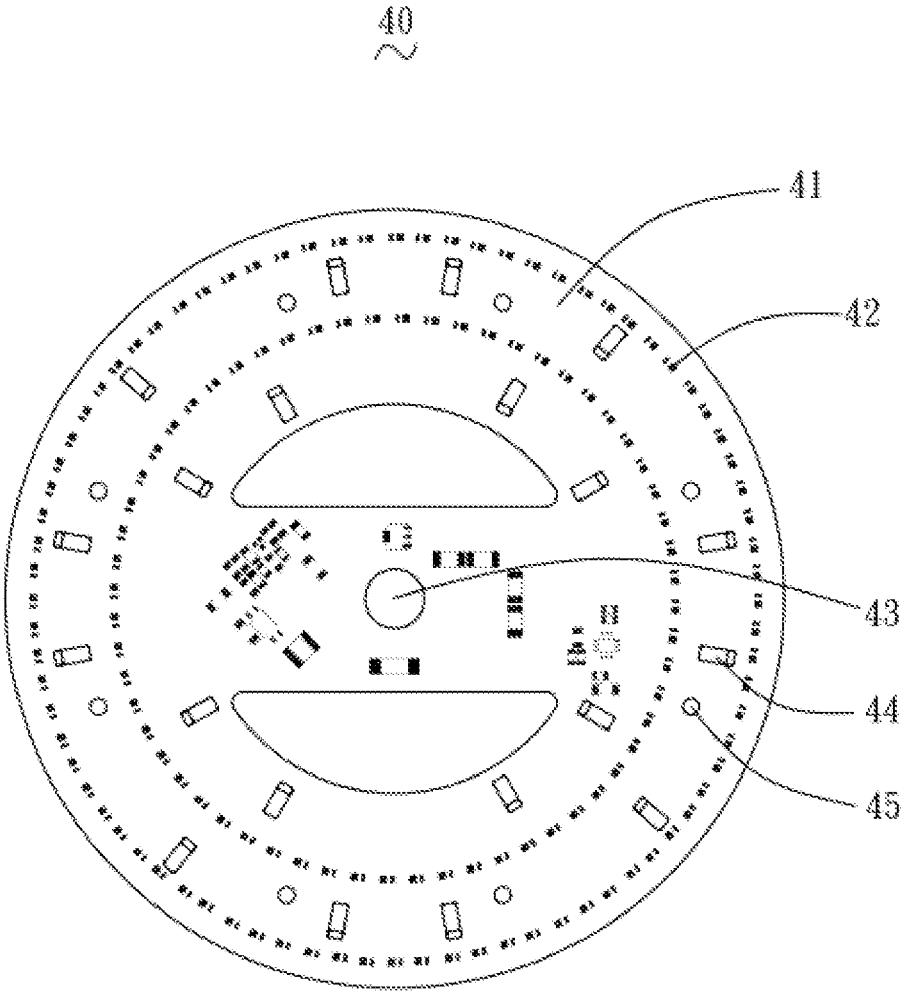
FIG. 5 is a schematic view of a light source assembly of FIG. 3.

Referring to FIG. 5, the light source assembly 40 includes a PCB 41, a plurality of LED beads 42 mounted on a bottom surface of the PCB 41; and a processing circuit 50 integrated on the PCB 41, wherein the processing circuit 50 is electrically coupled to the plurality of LED beads 42.

The light source assembly 40 is mounted between the mounting pedestal 30 and the insulating cover 60. In the illustrated embodiment, the PCB 41 is an aluminum substrate and defines a through hole 43 on a middle portion thereof. The external power supply line extends through the through hole 43 to electrically coupled to the processing circuit 50. The LED beads 42 are uniformly distributed on the PCB 41 in a double-lap and round ring manner to ensure uniform light emission. The PCB 41 defines a plurality of latching holes 44 corresponding to the plurality of hooks 34, and each latching hole 44 has a length of less than a length of each hook 34. The hook 34 is held in a state of being perpendicular to the pedestal portion 31 before installation. During installation, due to a soft texture of the hook 34, the hook 34 extends through the latching hole 44, and is bent to abut against the edge of the latching hole 44 to achieve the connection of the PCB 41 to the pedestal portion 31. The PCB 41 further defines a plurality of fifth connection holes 45, and the fifth connecting hole 45 is corresponding to the third connecting hole 35. The PCB 41 is further connected to a plurality of second supporting posts 47, each second supporting post 47 defines a second threaded hole (not shown) on one end thereof. The second threaded hole is aligned with the third connecting hole 35 and the fifth connecting hole 45, and the second supporting post 47 is fixed to the mounting pedestal 30 via the second screw. The second supporting post 47 has a second bolt on the other end thereof, the second bolt extends through the insulating cover 60 and is fastened via a second nut.

The PCB 41 is covered with the insulating cover 60, such that the electric shock caused by user direct contacting the PCB 41 can be prevented. In the illustrated embodiment, the insulating cover 60 is a transparent plastic plate. In alternative embodiments, the insulating cover 60 may be made of a glass material or an acrylic material. The insulating cover 60 defines a plurality of punching holes (not shown). The second supporting post 47 can extend through the punching holes.

Figure 6:
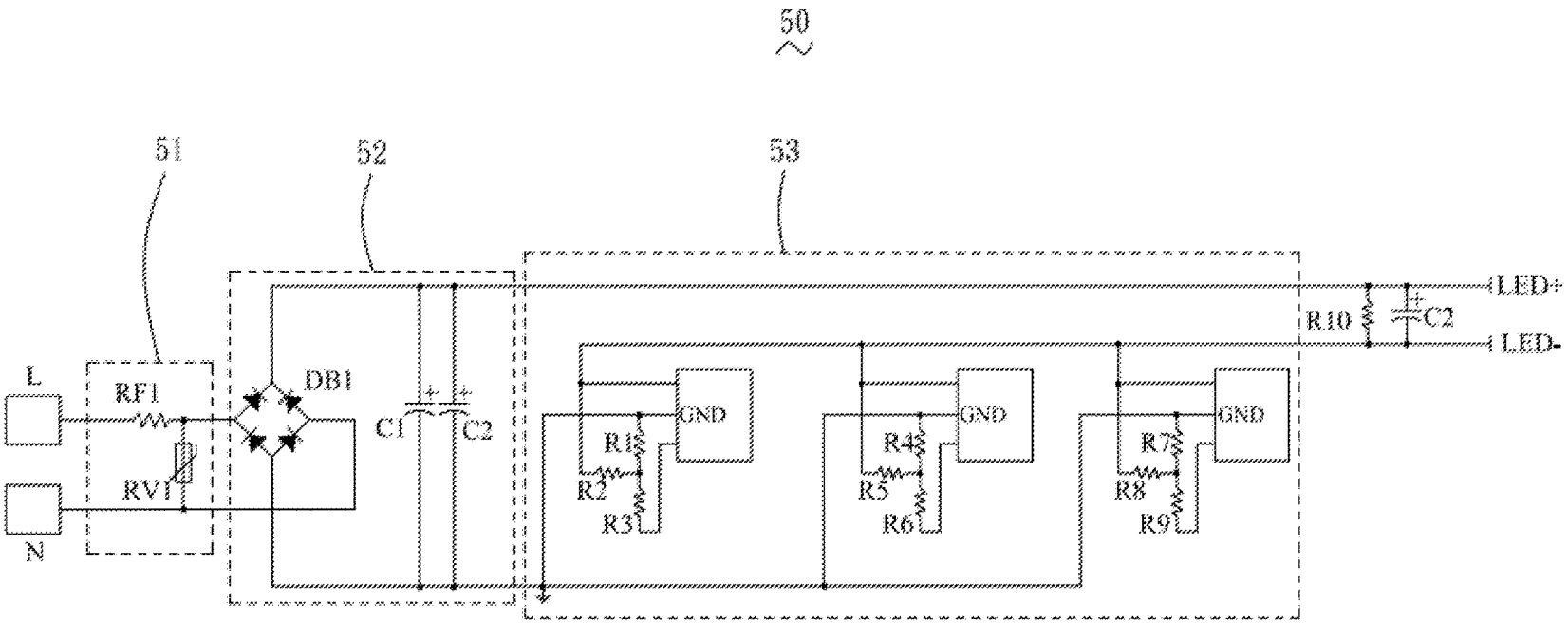
FIG. 6 is a block diagram of a processing circuit of FIG. 5.

Referring to FIG. 6, the processing circuit 50 includes a power consumption module 51 electrically coupled to a mains power supply, a rectifier module 52 electrically coupled to the power consumption module 51, and a constant current module 53 electrically coupled to the rectifier module 52. The constant current module 53 is configured to supply power to the plurality of LED beads 42. The power consumption module 51 includes a fusing resistor RF1 and a varistor RV1. The fusing resistor RF1 is electrically coupled to a live wire of the mains power supply to prevent overcurrent damage the circuit devices. The varistor RV1 is located in a subsequent circuit of the fusing resistor RF1. Both terminals of the varistor RV1 is electrically coupled to the live wire and a neutral wire of the mains power supply, respectively, thereby absorbing the circuit surge and suppressing the circuit electrostatic. Since the LED lamp is driven by direct current, the rectifier module 52 is required in the processing circuit 50. The rectifier module 52 is mainly a rectifier bridge DB1, which converts alternating current into direct current. The rectifier bridge DB1 is also connected in parallel with the two capacitors C1, C2, which can avoid the power instantaneous current is too large, thereby improving the reliability of the circuit. The constant current module 53 comprises a constant current control chip electrically coupled to an output terminal of the rectifier module 52. In the illustrated embodiment, the constant current module 53 is a constant current IC, by which the stable output of the current can be controlled.

Compared with the conventional lamps using light tubes or bulbs served as light source, the aforementioned ceiling lamp 100 integrates the LED beads 42 with the processing circuit 50 onto the PCB 41, thus the space structure is more compact. Meanwhile, the processing circuit 50 enables a stable voltage and current output, which may ensure that the aforementioned ceiling lamp 100 can emit stable light, thereby improving the luminous efficiency and prolonging the service life.

Although the respective embodiments have been described one by one, it shall be appreciated that the respective embodiments will not be isolated. Those skilled in the art can apparently appreciate upon reading the disclosure of this application that the respective technical features involved in the respective embodiments can be combined arbitrarily between the respective embodiments as long as they have no collision with each other. Of course, the respective technical features mentioned in the same embodiment can also be combined arbitrarily as long as they have no collision with each other.

The foregoing descriptions are merely specific embodiments of the present invention, but are not intended to limit the protection scope of the present invention. Any variation or replacement readily figured out by a person skilled in the art within the technical scope disclosed in the present invention shall all fall within the protection scope of the present invention. Therefore, the protection scope of the present invention shall be subject to the protection scope of the appended claims.

What is claimed is:

1. A ceiling lamp, comprising:

a lamp housing comprising a mounting bracket, a mounting pedestal mounted on the mounting bracket, an insulating cover connected to the mounting pedestal, and a lampshade enclosing the mounting bracket; and a light source assembly mounted in the lamp housing, the light source assembly comprising:

a printed circuit board (PCB);

a plurality of light-emitting diode (LED) beads mounted on a bottom surface of the PCB; and a processing circuit integrated on the PCB, the processing circuit being electrically coupled to the plurality of LED beads, the processing circuit comprising:

a power consumption module electrically coupled to a mains power supply, the power consumption module comprising a fusing resistor and a varistor, the fusing resistor being electrically coupled to a live wire of the mains power supply, and both terminals of the varistor being electrically coupled to the live wire and a neutral wire of the mains power supply, respectively;

a rectifier module electrically coupled to the power consumption module; and a constant current module electrically coupled to the rectifier module, the constant current module is configured to supply power to the plurality of LED beads, wherein the constant current module is a constant current control chip configured to provide a stable output of the current; and wherein the mounting bracket comprises an annular base plate and a side plate extending vertically from a periphery of the base plate, the base plate has an inner ring portion and an outer ring portion, the inner ring portion defines a plurality of uniformly spaced first connecting holes arranged on an annular circumference thereof, the outer ring portion defines a plurality of uniformly spaced second connecting holes arranged on an annular circumference thereof, each second connecting hole is configured to accommodate a first supporting post, each first connecting hole is configured to accommodate a second supporting post.

2. The ceiling lamp of claim 1, wherein the mounting pedestal comprises a pedestal portion, a bending portion extending from a periphery of the pedestal portion, and an abutting portion connected to the bending portion, the bending portion has a substantially inverted U-shaped cross-section, the bending portion is embedded in a annular inner side of the mounting bracket, and the abutting portion is connected to the base plate.

3. The ceiling lamp of claim 2, wherein the pedestal portion has a plurality of hooks formed on a side towards the insulating cover, the plurality of hooks are randomly distributed on the side of the pedestal portion, the PCB defines a plurality of latching holes corresponding to the plurality of hooks, each hook is latched in a latching hole.

4. The ceiling lamp of claim 3, wherein the plurality of hooks are formed by stamping.

5. The ceiling lamp of claim 2, wherein, the latching hole has a length of less than a length of the hook.

6. The ceiling lamp of claim 1, wherein the insulating cover is a transparent plastic plate.

7. The ceiling lamp of claim 1, wherein the lamp housing further comprising a fixing ring for securing the lampshade.

8. The ceiling lamp of claim 1, wherein the constant current control chip is electrically coupled to an output terminal of the rectifier module.

* * * * *